US010393073B2

(12) United States Patent
Park et al.

(10) Patent No.: US 10,393,073 B2
(45) Date of Patent: Aug. 27, 2019

(54) INTAKE MANIFOLD AND ENGINE INCLUDING THE SAME

(71) Applicants: HYUNDAI MOTOR COMPANY, Seoul (KR); KIA MOTORS CORPORATION, Seoul (KR)

(72) Inventors: Jungjoo Park, Gunpo-si (KR); Choo Saeng Choi, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 107 days.

(21) Appl. No.: 15/797,612

(22) Filed: Oct. 30, 2017

(65) Prior Publication Data

US 2018/0291846 A1 Oct. 11, 2018

(30) Foreign Application Priority Data

Apr. 6, 2017 (KR) ..... 10-2017-0044605

(51) Int. Cl.

| | |
|---|---|
| ***F02M 26/00*** | (2016.01) |
| ***F02M 26/35*** | (2016.01) |
| ***F02M 35/10*** | (2006.01) |
| ***F02M 26/17*** | (2016.01) |
| *F02M 35/104* | (2006.01) |

(52) U.S. Cl.

CPC ..... *F02M 26/35* (2016.02); *F02M 26/17* (2016.02); *F02M 35/10222* (2013.01); *F02M 35/104* (2013.01)

(58) Field of Classification Search

CPC ..... F02M 26/17; F02M 26/20; F02M 26/35; F02M 35/104; F02M 35/10144

See application file for complete search history.

(56) References Cited

U.S. PATENT DOCUMENTS

| | | | | |
|---|---|---|---|---|
| 7,131,263 | B1 * | 11/2006 | Styles | F02M 26/25 60/278 |
| 7,451,732 | B1 * | 11/2008 | Vichinsky | F02M 25/089 123/184.42 |
| 8,511,289 | B2 * | 8/2013 | Tanikawa | F02M 35/10039 123/184.42 |
| 9,057,346 | B2 * | 6/2015 | Sato | F02M 35/10072 |

(Continued)

FOREIGN PATENT DOCUMENTS

| | | | |
|---|---|---|---|
| JP | 2010-059921 | A | 3/2010 |
| KR | 10-1283144 | B1 | 7/2013 |

*Primary Examiner* — Hieu T Vo

*Assistant Examiner* — Sherman D Manley

(74) *Attorney, Agent, or Firm* — Morgan Lewis & Bockius LLP

(57) ABSTRACT

An intake manifold includes: a lower body having an air inlet through which an air flows; an EGR gas inlet through which an EGR gas flows; and a plurality of lower runners disposed at the plurality of combustion chambers, respectively, to supply the air inflowing through the air inlet and the EGR gas inflowing through the EGR gas inlet to each of the plurality of combustion chambers; and an upper body combined with the lower body and having one side connected to the plurality of lower runners and another side having an upper runner connected to the intake port. The lower body further includes a condensed water storage apparatus temporary storing a condensed water generated by a mixture of the air and the EGR gas.

12 Claims, 6 Drawing Sheets

(56) References Cited

U.S. PATENT DOCUMENTS

| | | | | |
|---|---|---|---|---|
| 2006/0191505 | A1* | 8/2006 | Doko | F02M 35/10039 123/184.59 |
| 2009/0223476 | A1* | 9/2009 | Shinkai | F02M 26/12 123/184.21 |
| 2011/0079002 | A1* | 4/2011 | Siuchta | F02M 26/30 60/309 |
| 2014/0338628 | A1* | 11/2014 | Ito | F02M 35/10091 123/184.55 |
| 2016/0097332 | A1* | 4/2016 | Ulrey | F02D 41/0065 123/403 |
| 2017/0211519 | A1* | 7/2017 | Ito | F02M 35/104 |
| 2017/0306895 | A1* | 10/2017 | Teramoto | F02M 35/104 |
| 2018/0171944 | A1* | 6/2018 | Nakamura | F02M 35/10157 |
| 2018/0179999 | A1* | 6/2018 | Yoshioka | F02M 35/10222 |

* cited by examiner

INTAKE MANIFOLD AND ENGINE INCLUDING THE SAME

CROSS-REFERENCE TO RELATED APPLICATION

This application claims the benefit of priority to Korean Patent Application No. 10-2017-0044605 filed in the Korean Intellectual Property Office on Apr. 6, 2017, the entire content of which is incorporated herein by reference.

TECHNICAL FIELD

The present disclosure relates to an intake manifold and an engine system including the same. More particularly, the present disclosure relates to an intake manifold preventing condensed water generated when an exhaust gas recirculation (EGR) gas and a fresh air are mixed from being inflowing inside a combustion chamber and an engine system including the same.

BACKGROUND

In an engine of a vehicle, a mixture of air inflowing from the outside and a fuel is combusted at an appropriate ratio to generate a power.

In a process of generating the power by driving the engine, the external air for the combustion must be appropriately supplied to obtain a desired output and combustion efficiency. After the combust for the power generation of the engine, an exhaust gas is generated and then this exhaust gas is exhausted to an outside.

Further, a nitrogen oxide (NOx) included in the exhaust gas is regulated as an atmospheric pollution source and there has been an effort to lessen exhaust of NOx.

An exhaust gas recirculation (EGR) system has been provided to a vehicle for reducing noxious exhaust gas. Generally, NOx is increased in a case where an air-fuel ratio of an air-fuel mixture is high, which is necessary for sufficient combustion. Thus, the exhaust gas recirculation system mixes exhaust gas from an engine with the air-fuel mixture, for example at 5-20%, thereby reducing the amount of oxygen in the air-fuel mixture and obstructing combustion, and so lessening generation of NOx.

As a representative exhaust gas recirculation system in a related art, there is a low pressure exhaust gas recirculation (LP-EGR) apparatus. The low pressure EGR apparatus recirculates the exhaust gas into an intake pathway.

However, the exhaust gas that is recirculated by the exhaust gas recirculation system generally has high temperature and humidity. Accordingly, when the recirculate exhaust gas of high temperature and inflowing fresh air of low temperature are mixed, condensed water is generated in an intake manifold. In this case, the generated condensed water has very high acidity due to various harmful components contained in the exhaust gas.

Further, there is a problem that peripheral parts to which the exhaust gas flows were corroded by the condensed water of high acidity, if the condensed water inflows to the combustion chamber of the engine, a problem that the combust becomes unstable is generated.

Additionally, In regions where the temperature is low, when the generated condensed water is frozen in the intake manifold, there may be a problem that each intake pathway connected with each combustion chamber is clogged.

The above information disclosed in this Background section is only for enhancement of understanding of the background of the invention and therefore it may contain information that does not form the prior art that is already known in this country to a person of ordinary skill in the art.

SUMMARY

The present disclosure provides an intake manifold preventing condensed water generated, when an exhaust gas recirculation (EGR) gas and fresh air are mixed, from being inflowing inside a combustion chamber and an engine system including the same.

An intake manifold according to an exemplary embodiment of the present disclosure includes: a lower body having an air inlet through which an air flows; an exhaust gas recirculation (EGR) gas inlet through which an EGR gas inflows; and a plurality of lower runners disposed at a plurality of combustion chambers, respectively, to supply an air inflowing through the air inlet and an EGR gas inflowing through the EGR gas inlet into each of the plurality of combustion chambers; and an upper body combined with the lower body and having one side connected to the plurality of lower runners and another side having an upper runner connected to the intake port. The lower body further includes a condensed water storage apparatus temporary storing a condensed water generated by a mixture of the air and the EGR gas. The condensed water storage apparatus may include a concaved portion formed an upper entrance of the lower runner, a first exhaust hole formed at the concaved portion and in communication with each lower runner, a second exhaust hole formed at a lower entrance of the lower runner, and a chamber body where a storage space storing the condensed water is formed under the second exhaust hole.

The concaved portion may be formed to be concave toward a lower part from the upper entrance of the lower runner.

An absorption member absorbing the condensed water may be provided in the storage space.

The absorption member may be formed through a high temperature sintering process after laminating a metal fiber.

A size of a mesh formed at the absorption member may be smaller than the size of a water molecule and may be larger than the size of a water vapor.

An engine system according to another exemplary embodiment of the present disclosure includes: an engine having a plurality of combustion chambers for generating a driving torque by fuel combustion; an exhaust gas recirculation (EGR) apparatus recirculating a part of an exhaust gas between the plurality of combustion chambers; and an intake manifold distributing an air inflowing through an intake line from outside and an EGR gas recirculating through the exhaust gas recirculation apparatus to the combustion chambers. The intake manifold includes: a lower body having an air inlet through which the air flows; an EGR gas inlet through which the EGR gas inflows; and a plurality of lower runners disposed at the plurality of combustion chambers, respectively, to supply the air inflowing through the air inlet and the EGR gas inflowing through the EGR gas inlet to the plurality of combustion chambers; an upper body combined with the lower body and having one side connected to the plurality of lower runners and another side having an upper runner connected to the intake port; and a condensed water storage apparatus temporary storing a condensed water generated by a mixture of the air and the EGR gas in the lower body.

The condensed water storage apparatus may include a concaved portion formed an upper entrance of the lower runner, a first exhaust hole formed at the concaved portion and in communication with each lower runner, a second exhaust hole formed at a lower entrance of the lower runner, and a chamber body where a storage space storing the condensed water is formed under the second exhaust hole.

The concaved portion may be formed to be concave toward a lower part from the upper entrance of the lower runner.

An absorption member absorbing the condensed water may be provided in the storage space.

The absorption member may be formed through a high temperature sintering process after laminating a metal fiber.

A size of a mesh formed at the absorption member may be smaller than the size of a water molecule and may be larger than the size of a water vapor.

As above-described, according to the intake manifold and the engine system including the same according to the exemplary embodiment of the present disclosure, because the condensed water generated when the air of low temperature and the EGR gas of high temperature and high humidity are mixed inside the intake manifold is absorbed to the absorption member provided at the storage space of the chamber body, the condensed water may be prevented from flowing inside the intake manifold, thereby the condensed water may be prevented from inflowing into the combustion chamber.

Accordingly, it may be prevented that the condensed water inflows inside the combustion chamber such that the combust becomes unstable or the intake pathway is clogged by the ice of the condensed water.

BRIEF DESCRIPTION OF THE DRAWINGS

The drawings are provided for reference to explain an illustrative exemplary embodiment of the present disclosure, and the technical spirit of the present disclosure should not be interpreted to be limited to the accompanying drawings.

DETAILED DESCRIPTION OF THE EMBODIMENTS

Figure 1:
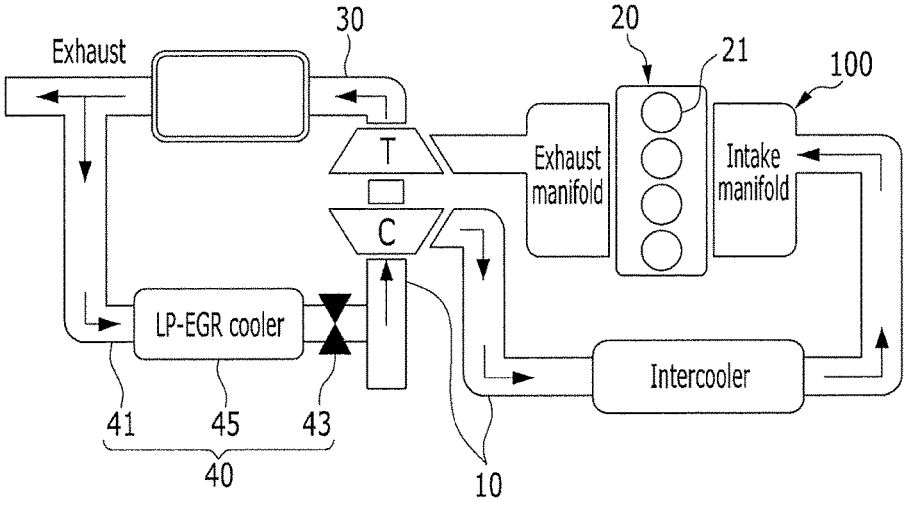
FIG. 1 is a schematic view of an engine system to which an intake manifold is applied according to an exemplary embodiment of the present disclosure.

The present disclosure will be described more fully hereinafter with reference to the accompanying drawings, in which exemplary embodiments of the invention are shown. As those skilled in the art would realize, the described embodiments may be modified in various different ways, all without departing from the spirit or scope of the present disclosure.

In describing the present disclosure, parts that are not related to the description will be omitted. Like reference numerals generally designate like elements throughout the specification.

Further, in the drawings, a size and thickness of each element are randomly represented for better understanding and ease of description, and the present disclosure is not limited thereto.

Hereinafter, an intake manifold of a fiber bundle according to an exemplary embodiment of the present disclosure will be described in detail with reference to the accompanying drawings. For this, a structure of an engine system to which an intake manifold is applied according to an exemplary embodiment of the present disclosure will be firstly described.

FIG. 1 is a schematic view of an engine system to which an intake manifold is applied according to an exemplary embodiment of the present disclosure.

As shown in FIG. 1, an engine system to which an intake manifold is applied according to an exemplary embodiment of the present disclosure includes: an intake line 10 to which a fresh air inflows; an engine 20 including a plurality of combustion chambers 21 generating a driving torque by a combust of a fuel; an exhaust line 30 to which an exhaust gas exhausted from each of the combustion chambers 21 flows; and an exhaust gas recirculation (EGR) apparatus 40 recirculating a part of the exhaust gas exhausted through the exhaust line 30 to each of the combustion chambers 21.

The EGR apparatus 40 may include an EGR line 41 branching from the exhaust line 30 and joining the intake line 10, an EGR valve 43 disposed on the EGR line 41, and an EGR cooler 45 installed to the EGR line 41.

If an opening of the EGR valve 43 is controlled, an EGR gas amount supplied to the combustion chambers 21 is controlled. The EGR cooler 45 cools an EGR gas flowing to the EGR line. In an exemplary embodiment of the present disclosure, the low pressure EGR apparatus is described as an example, but the scope of the present disclosure is not limited to this, and other structures of EGR devices may be applied.

The fresh air inflowing through the intake line 10 from the outside and the EGR gas recirculating through the exhaust gas recirculation apparatus 40 are distributed to the combustion chambers 21 through an intake manifold 100.

Next, the structure of the intake manifold according to an exemplary embodiment of the present disclosure will be described in detail with reference to accompanying drawings.

Figure 2:
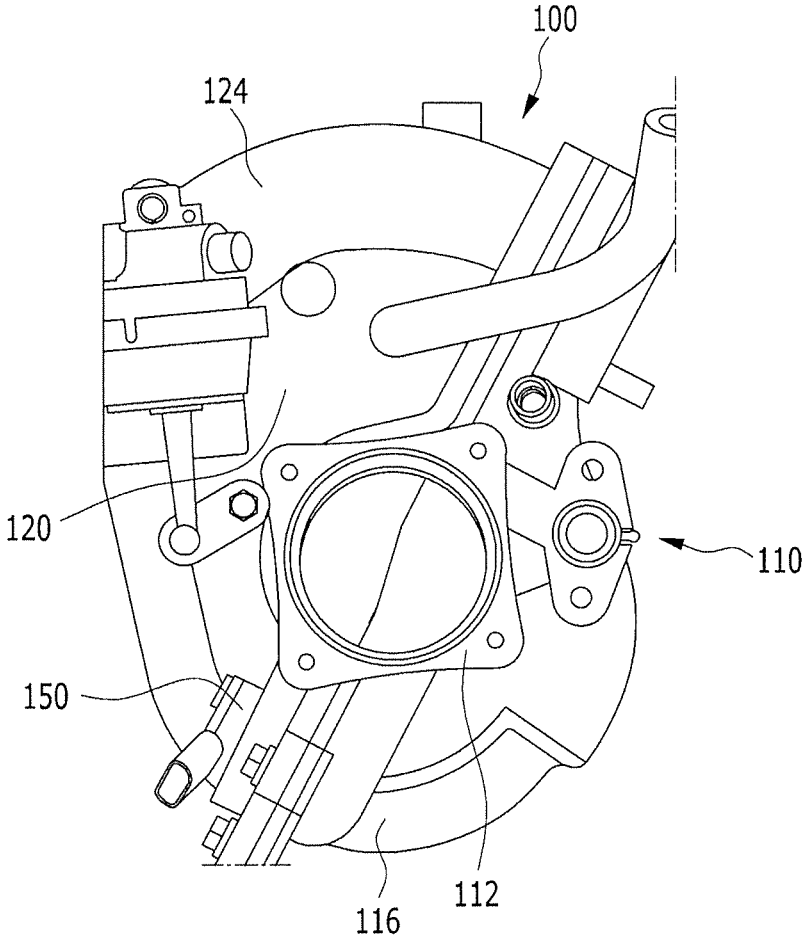
FIG. 2 is a side view showing configurations of an intake manifold according to an exemplary embodiment of the present disclosure.
Figure 3:
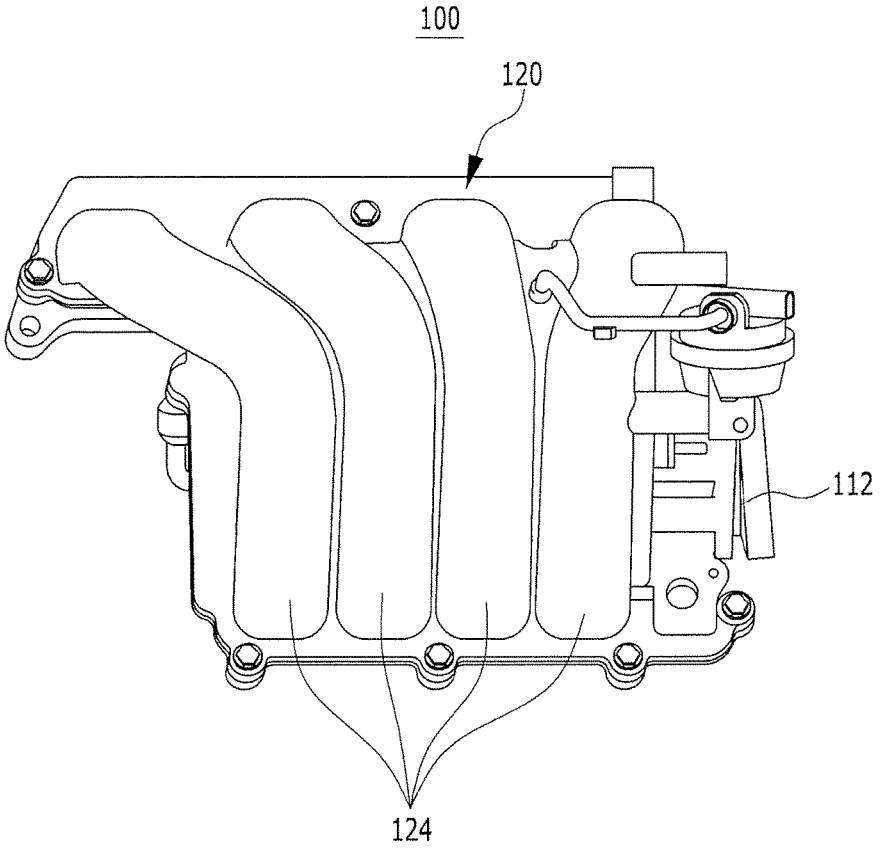
FIG. 3 is a front view showing configurations of an intake manifold according to an exemplary embodiment of the present disclosure.
Figure 4:
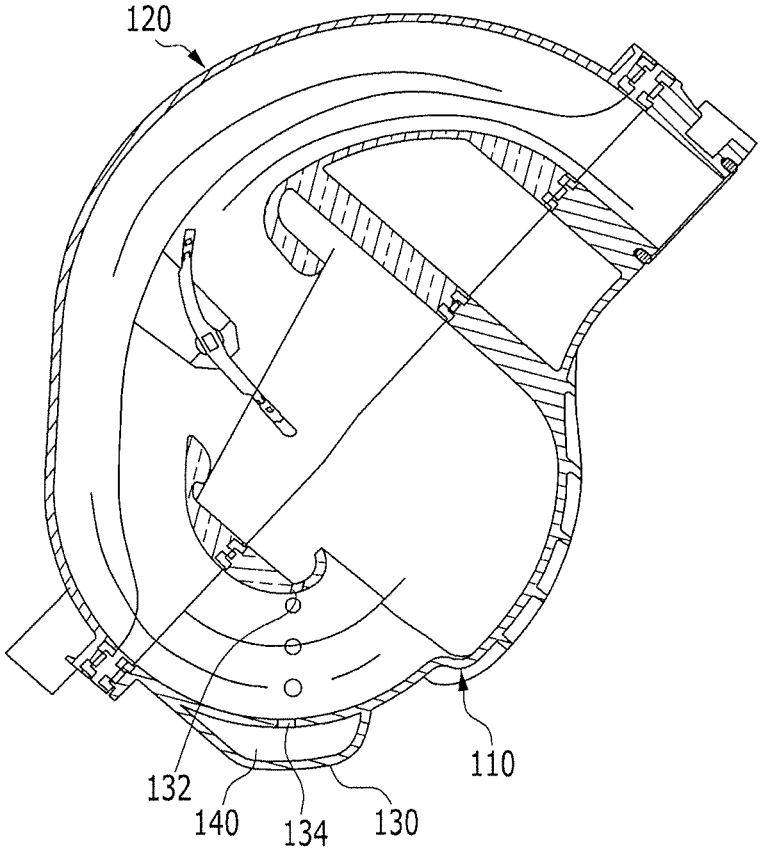
FIG. 4 is a cross-sectional view showing configurations of an intake manifold according to an exemplary embodiment of the present disclosure.

FIG. 2 is a side view showing configurations of an intake manifold according to an exemplary embodiment of the present disclosure. FIG. 3 is a front view showing configurations of an intake manifold according to an exemplary embodiment of the present disclosure. FIG. 4 is a cross-sectional view showing configurations of an intake manifold according to an exemplary embodiment of the present disclosure.

Figure 5:
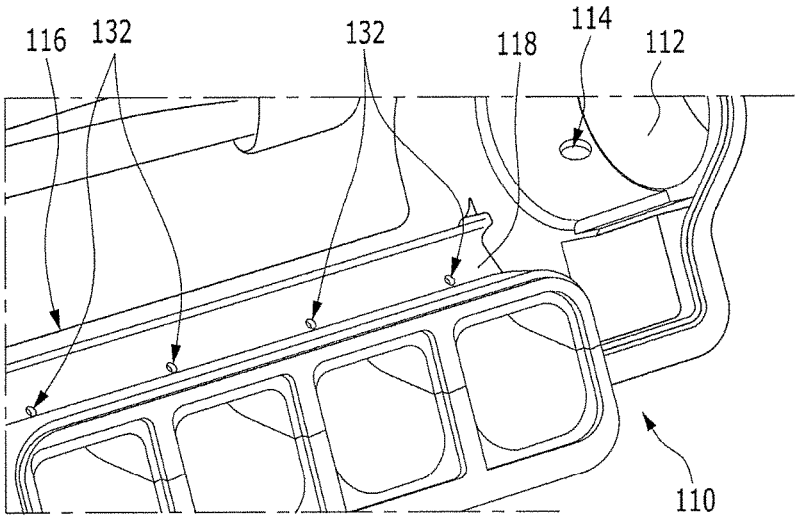
FIG. 5 is an internal perspective view of a lower body applied to an intake manifold according to an exemplary embodiment of the present disclosure.

FIG. 5 is an internal perspective view of a lower body applied to an intake manifold according to an exemplary embodiment of the present disclosure.

Figure 6:
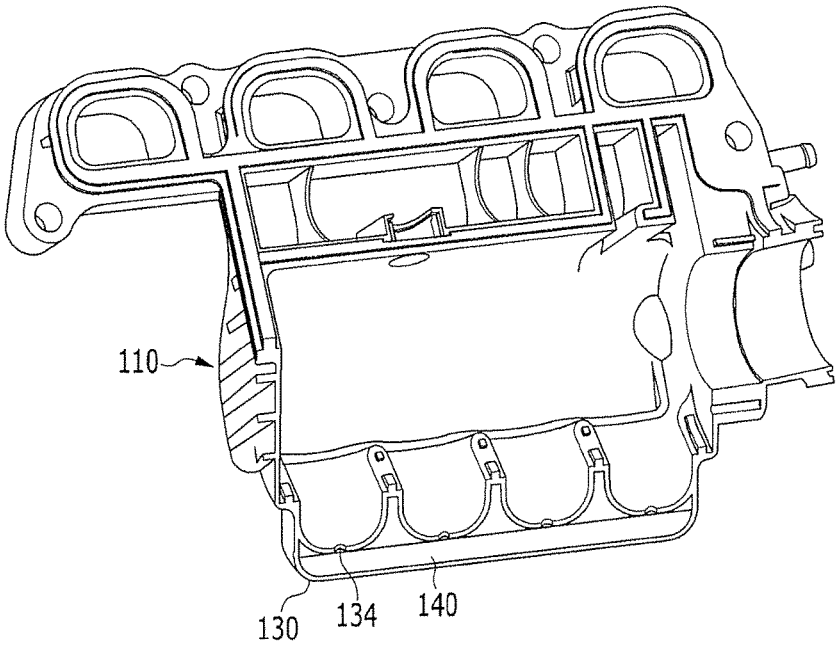
FIG. 6 is a perspective view of a lower body applied to an intake manifold according to an exemplary embodiment of the present disclosure.

FIG. 6 is a perspective view of a lower body applied to an intake manifold according to an exemplary embodiment of the present disclosure.

Referring to FIG. 2 to FIG. 6, the intake manifold 100 includes a lower body 110, an upper body 120 combined with the lower body 110, and a condensed water storage apparatus temporary storing the condensed water generated in the intake manifold 100.

In the lower body 110, a fresh air inlet 112 is formed so that the fresh air inflows inside the intake manifold 100. The fresh air may inflow into each of the combustion chambers 21 through the fresh air inlet 112.

In the fresh air inlet 112, an EGR gas inlet 114 in communication with the EGR line 41 is formed. A part (EGR gas) of the exhaust gas recirculating through the EGR gas inlet 114 inflows inside the intake manifold 100.

In the lower body 110, a plurality of lower runners 116 is provided corresponding to each of the combustion chambers 21.

The upper body 120 is combined with the lower body 110, and an upper runner 124 has one end connected to the lower runners 116 and another end connected to an intake port (not shown). In the upper body 120, a manifold absolute pressure (MAP) sensor 150 measuring a pressure inside the intake manifold 100 may be provided.

In the lower body 110, a condensed water storage apparatus temporary storing the condensed water generated when the fresh air and the EGR gas are mixed inside the intake manifold 100 is provided.

The condensed water storage apparatus may include a concaved portion 118 formed at the upper entrance of each of the lower runners 116, a first exhaust hole 132 formed at the concaved portion 118 and in communication with each of the lower runners 116, a second exhaust hole 134 formed at a lower entrance of each of the lower runners 116, and a chamber body 130 in which a storage space storing the condensed water under the second exhaust hole 134.

The concaved portion 118 may be concaved toward a lower part from the upper entrance of each of the lower runners 116. In the concaved portion 118, condensed water generated inside the intake manifold 100 can be temporarily gathered and stored.

The second exhaust hole 134 is formed under the first exhaust hole 132, and thus, the second exhaust hole 134 may be formed at a position corresponding to the first exhaust hole 132.

In the storage space formed at the chamber body 130, an absorption member 140 absorbing the condensed water generated in the intake manifold 100 may be provided. The absorption member 140 absorbs the condensed water generated in the intake manifold 100, thereby preventing the condensed water from flowing inside the intake manifold 100.

For this, the absorption member 140 may be formed through a high temperature sintering process after a metal fiber of a micrometer unit is laminated one layer by one layer. In this case, a size of a mesh may be formed by the metal fiber is smaller than the size of a water molecule and is larger than the size of a water vapor molecule. Accordingly, the absorption member 140 maintains a state that the condensed water is absorbed, and may be exhausted in a vapor state if the condensed water is vaporized.

Hereinafter, an operation of the engine system applying the intake manifold according to an exemplary embodiment of the present disclosure will be described in detail.

If the fresh air of low temperature inflowing through the intake line from the outside and the EGR gas of high temperature and high humidity recirculated through the EGR line inflow to the intake manifold 100, the condensed water is generated in the intake manifold 100.

In this case, the generated condensed water is gathered and stacked at the concaved portion 118 formed to be concave at the upper entrance of the lower runner 116.

The condensed water gathered at the concaved portion 118 inflows into the storage space of the chamber body 130 through the first exhaust hole 132 and the second exhaust hole 134. As described above, the inflowing condensed water is absorbed to the absorption member 140 provided in the storage space. Accordingly, since the condensed water may be prevented from moving inside the intake manifold 100, the condensed water may be prevented from inflowing inside the combustion chambers 21.

In addition, the condensed water absorbed at the absorption member 140 of the storage chamber is evaporated by the fresh air and the EGR gas flowing inside the intake manifold 100 in a condition that the condensed water is not generated and inflows to the combustion chambers 21 in a form of a water vapor.

As above-described, according to the intake manifold 100 and the engine system including the same according to an exemplary embodiment of the present disclosure, because the condensed water generated when the fresh air of low temperature and the EGR gas of high temperature and high humidity are mixed inside the intake manifold 100 is absorbed to the absorption member 140 provided at the storage space of the chamber body 130, the condensed water may be prevented from flowing inside the intake manifold 100, thereby the condensed water may be prevented from inflowing into the combustion chambers 21.

Accordingly, it may be prevented that the condensed water inflows inside the combustion chamber such that the combust becomes unstable or the intake pathway is clogged by the ice of the condensed water.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An intake manifold comprising:

a lower body having: an air inlet through which an air inflows into the lower body; an exhaust gas recirculation (EGR) gas inlet through which an EGR gas inflows; and a plurality of lower runners disposed at a plurality of combustion chambers, respectively, to supply the air inflowing through the air inlet and the EGR gas inflowing through the EGR gas inlet to each of the combustion chambers; and an upper body combined with the lower body, the upper body having one side connected to the plurality of lower runners and another side having an upper runner connected to the intake port, wherein the lower body further includes a condensed water storage apparatus temporary storing a condensed water generated by a mixture of the air and the EGR gas.

2. The intake manifold of claim 1, wherein the condensed water storage apparatus includes:

a concaved portion at an upper entrance of the plurality of lower runners, a first exhaust hole at the concaved portion and communicating with each of the plurality of lower runners, a second exhaust hole at a lower entrance of the plurality of lower runners, and a chamber body having a storage space under the second exhaust hole, the storage space storing the condensed water.

3. The intake manifold of claim 2, wherein:

the concaved portion is concaved toward a lower part from the upper entrance of the plurality of lower runners.

4. The intake manifold of claim 2, wherein:

the storage space includes an absorption member absorbing the condensed water.

5. The intake manifold of claim 4, wherein:

the absorption member is formed of a laminated metal fiber through a high temperature sintering process.

6. The intake manifold of claim 5, wherein:

the absorption member has a mesh having a diameter smaller than that of a water molecule and larger than that of a water vapor.

7. An engine system comprising:

an engine having a plurality of combustion chambers for generating a driving torque by fuel combustion;

an exhaust gas recirculation apparatus recirculating a part of an exhaust gas exhausted from and to the plurality of combustion chambers; and an intake manifold distributing an air inflowing through an intake line from outside and an exhaust gas recirculation (EGR) gas recirculating through the exhaust gas recirculation apparatus to the plurality of combustion chambers, wherein the intake manifold includes:

a lower body having an air inlet through which the air flows;

an EGR gas inlet through which the EGR gas flows, and a plurality of lower runners disposed on the plurality of combustion chambers, respectively, to supply the air inflowing through the air inlet and the EGR gas inflowing through the EGR gas inlet to each of the plurality of combustion chambers;

an upper body combined with the lower body and having one side connected to the plurality of lower runners and another side having an upper runner connected to the intake port; and a condensed water storage apparatus temporary storing a condensed water generated by a mixture of air and an EGR gas in the lower body.

8. The engine system of claim 7, wherein the condensed water storage apparatus includes:

a concaved portion formed at an upper entrance of the plurality of lower runners, a first exhaust hole formed at the concaved portion and in communication with each of the plurality of lower runners, a second exhaust hole formed at a lower entrance of the plurality of lower runners, and a chamber body having a storage space under the second exhaust hole, the storage space storing the condensed water.

9. The engine system of claim 8, wherein:

the concaved portion is concaved toward a lower part from the upper entrance of the plurality of lower runners.

10. The engine system of claim 8, wherein:

the storage space has an absorption member absorbing the condensed water.

11. The engine system of claim 10, wherein:

the absorption member is formed of a laminated metal fiber through a high temperature sintering process.

12. The engine system of claim 11, wherein:

the absorption member includes a mesh having a diameter smaller than that of a water molecule and larger than that of a water vapor.

* * * * *